US006052918A

United States Patent [19]

Oletzke

[11] Patent Number: 6,052,918

[45] Date of Patent: Apr. 25, 2000

[54] PORTABLE UNITARY DRYING DEVICE

[75] Inventor: James G. Oletzke, P.O. Box 07297, Ft. Myers, Fla. 33919

[73] Assignee: James G. Oletzke, Ft. Myers, Fla.

[21] Appl. No.: 09/349,956

[22] Filed: Jul. 9, 1999

[51] Int. Cl.[7] ..... A01F 25/12

[52] U.S. Cl. ..... 34/239; 248/220.21; 211/119.004

[58] Field of Search ..... 34/91, 103, 192, 34/194, 237, 238, 239; 248/220.21, 220.22, 224.7, 224.8, 200, 201; 211/119.004, 119.005, 119.006, 119.007, 119.009, 99, 168

[56] References Cited

U.S. PATENT DOCUMENTS

| | | | |
|---|---|---|---|
| 2,024,892 | 12/1935 | Soper | 211/123 |
| 4,372,449 | 2/1983 | Fink | 211/86 |
| 4,901,871 | 2/1990 | Ohm et al. | 211/86 |

*Primary Examiner*—Pamela A. Wilson

[57] ABSTRACT

A portable rigid and unitary device for drying articles placed thereon. The device is a frame made of two side supporting members that are rigidly connected by crosspieces or rungs. Each free end of the supporting member is bent so as to form a semi-circle or U-shaped configuration which is hooked over a top edge of a supporting panel on which the device is installed. The ends of the supporting member are in contact with a rear surface of the support panel. The other ends of the supporting members with the rungs attached thereto extend forward from an outer surface of the supporting panel at an angle and the angle is maintained by a brace on each of the supporting members which extends toward the outer surface and is in contact therewith. In this manner, the drying rungs are spaced from each other vertically and horizontally. The arrangement of hooks and braces assures a secure and vibration-free installation.

9 Claims, 3 Drawing Sheets

PORTABLE UNITARY DRYING DEVICE

BACKGROUND OF THE INVENTION

1. Field of the Invention

This invention relates to devices for drying various articles such as towels, swim suits and apparel. More particularly, this invention relates to a drying device in the form of a rack. Racks are known having single or multiple rungs on which various articles are hung so that they can be air dried. In many instances, the rungs are not spaced apart far enough so that the drying air cannot pass between the articles which impedes or prolongs the drying process which under certain circumstances can result in mold and/or mildew developing on the articles which, of course, is highly undesirable.

2. Description of the Prior Art

U.S. Pat. No. 2,295,736 describes a foldable rack having an excessive number of pivotal and slidable members. As its title suggest, it is a foldable device for storage when not in use.

U.S. Pat. No. 1,596,346 is a foldable rack which has not been designated as a drying rack at all but as a support for articles to be placed thereon and hung on an edge of a washing machine. It is also a foldable device and can be collapsed into a substantially flat configuration.

SUMMARY OF THE INVENTION

It is an object of the invention to provide a portable drying and aerating device that is ready for immediate use.

Contrary to other known prior art devices, this invention is of a unitary and rigid construction resulting in a device having no moving parts.

It is another object of the invention to provide a device that is light in weight and has a minimum of contact points for support and positioning so as to not obstruct or interfere with existing fixtures on the object on which it is hung or suspended.

The invention is intended to be installed mainly on shower stalls in recreational vehicles "RV's" or boats. Of course, other uses will readily become apparent. The drying device could be installed on side panels or swinging doors of such shower stalls. The device is adapted at one end thereof to fit over the top of swinging doors, shower enclosures, and other planar surfaces and at the other end of a section of the device to be angularly disposed away from such doors or panels. A multiple of rungs, that are disposed on this section, are thereby disposed in an arrangement wherein the rungs are spaced from each other vertically and horizontally so as to promote efficient drying and aerating of the article hung thereon.

It should also be understood that the above modes of transportation will create a vibration within the vehicle, whereby the device would also be vibrating which fact is undesirable. To this end, it does not suffice to merely hang the device over the supporting panel and to contact the same only on its rear side but to clamp the device into a stable configuration against the supporting panel. To alleviate any vibration, the device is also supported against the supporting surface on its outwardly facing surface by a support or brace directed from the angular section toward the supporting panel to contact the same. This then will a create a two point contact between the rear and front surfaces of the supporting panel. This type of contact acts as a fulcrum to securely maintain the device in a stable position.

The foregoing objects are realized in the present invention in a device having a unitary frame that is adapted at one end to fit over existing appropriate structures and at the other end to extend downward and outward at a selected angle so as to deploy a series of rungs that are spaced apart from each other vertically and horizontally to provide a separation of articles hung thereon and to promote the drying of the same.

Another feature on the drying device is designed so that the device, once it is installed on a supporting structure, cannot vibrate or become dislodged.

BRIEF DESCRIPTION OF THE DRAWINGS

The foregoing and further objects of the invention will become apparent from a reading of the following description of preferred embodiments of the invention.

DETAILED DESCRIPTION OF THE INVENTION

Figure 1:
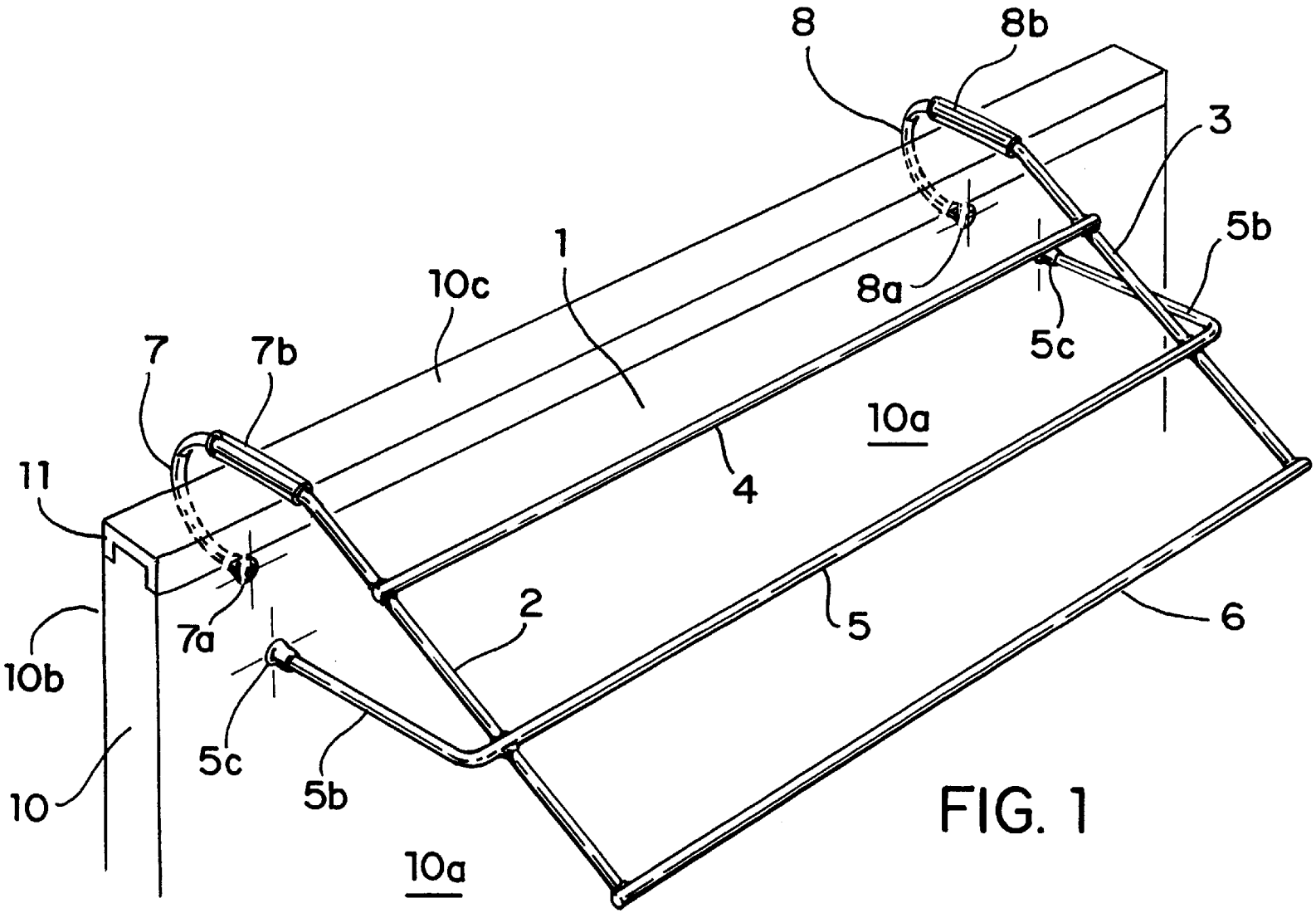
FIG. 1 is a perspective view and shows the drying device installed on a supporting panel.

Turning now to the drawings, the portable unitary drying device is shown to include a first support member 2 and a second support member 3. Both support members 2 and 3 are connected by crosspieces or rungs 4, 5, and 6 and rigidly connected to the same. The crosspieces or rungs can be more or less in numbers, both support members 2 and 3 have free ends 7 and 8 which are bent into a semi-circle or U-shaped configuration. The U-shaped ends are hooked over a panel or door 10 having an outer surface 10*a* and a rear surface 10*b* and an upper edge surface 10*c*. The panel or door 10 could also have a top molding 11. When the unitary device is installed over the panel or door 10 it should have a support for the purpose of supporting the same at an angular position which includes an angle relative to an outer surface 1 of the support panel 10 as is shown by arrow 19. This should satisfy the examiner's objection to the drawings in that the numeral 1 shown in FIG. 1 was not described in the specification. To this end, the crosspiece or rung 5 is somewhat extended over each support member 2 and 3 and is then angled or formed as shown by 5*b* toward or in the direction of the support panel 10 to thereby act as brace. The length of 5*b* is chosen so that the section 2, 3, 4, 5, and 6 is angled downwardly so that the crosspieces or rungs 4, 5, and 6 are disposed spaced apart from each other in a vertical direction. Experiments have shown that the rung 6 should not be bent in the manner that the rung 5 was bent, that is, midway of the angulated section. The angulated section extends from the end where it is in contact with the upper edge of the support panel to the free forward end. It was found that the clamping effect of a fulcrum could not be obtained and any possible vibrations could not be eliminated. At the ends of the sections 5*c*, the cushioning caps 5*c* are provided so as not to scratch the surface of the outer surface 10*a* of panel 10. The same cushioning caps 7*a* and 8*a* are provided at the ends of the bent back free ends 7 and 8. In order to prevent any scratching or damage on the upper edge 10*c* of the panel 10, protective sleeves 7*b* and 8*b* have been provided on the free ends 7 and 8 of the support members 2 and 3. These sleeves 7*b* and 8*b* are also instrumental in cushioning any possible vibrations.

Figure 2:
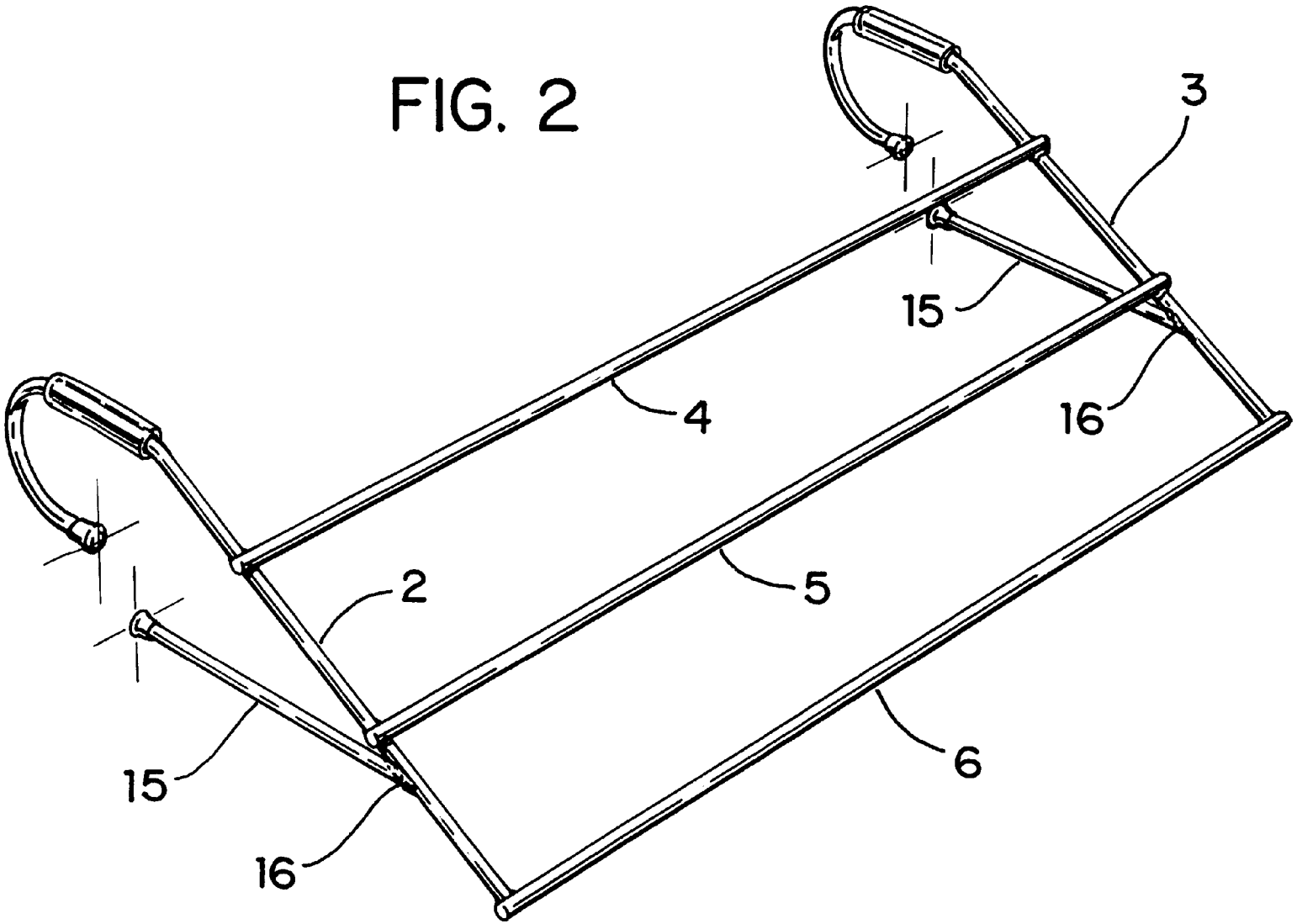
FIG. 2 is a perspective view of the drying device of FIG. 1 but having a different brace support.

Turning now to FIG. 2, the same reference characters have been applied to the same elements as were identified in FIG. 1. The only difference in this FIG. 2 is that instead of bending the crosspiece or rung 5 toward the panel 10, separate elements 15 acting as braces have been provided which are being welded at 16 to the support elements 2 and 3.

Figure 3:
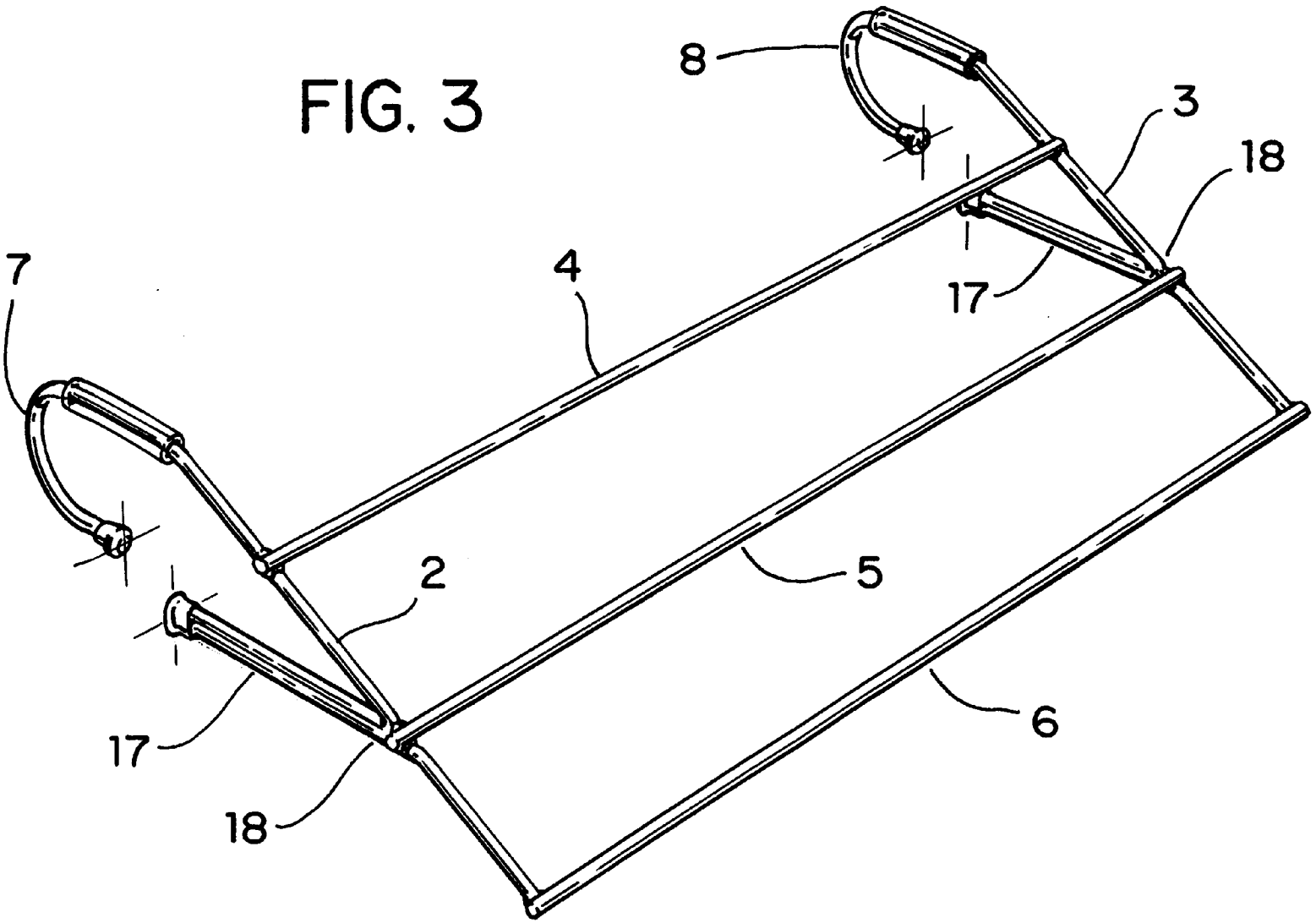
FIG. 3 is a perspective view of the drying device of FIG. 1 but having still a different brace support.

FIG. 3 shows still another embodiment of the section that spaces the drying device from the supporting panel at an angulated position which includes an angle relative to an outer surface 1 of the support panel 10 as is shown by arrow 19. In this embodiment, each of the supporting elements 2 and 3 are bent back upon themselves as at 17 to form a brace in order to obtain a spacing section. The doubled back elements 2 and 3 could be welded rigid as at 18. The embodiments shown in FIGS. 2 and 3 are not preferred because they would be more complicated and be more expensive to manufacture. Therefore, the embodiment of FIG. 1 is preferred wherein the crosspiece or rung is bent and extended toward the support panel 10.

The components of the drying device may be fabricated from conventional materials such as metal, plastic or composites, however, the preferred material is metal which preferably is coated with epoxy or powder paint to prevent rusting and to improve the esthetic appearance. The horizontal crosspieces or rungs and supporting members are preferably made of cylindrical rod material having a diameter that is related to their lengths and to the articles to be hung on the device.

In a three-rung embodiment, the middle rung functions both as a support for articles to be hung and also as brace for the device against the outer surface of the supporting panel while at the same establishing the clamping fulcrum.

Although this invention has been disclosed and described with reference to preferred embodiments, its principles are susceptible to other applications which will be apparent to those skilled in the art. For example, additional rungs and a center support may be added to accommodate a greater number of articles to be dried. Also the rungs could be formed into a curved configuration so that the device could be hung or supported on a curved panel which may be present in certain shower stalls. It is also readily apparent said the device of the invention at hand does not have to be used just for drying articles but also be used to provide additional storage for items such as towels. Thus, many modifications, additions and deletions may be made to the invention without departing from the scope of the invention as set forth in the following claims.

What is claimed is:

1. An article drying device comprising of a unitary and rigid frame, said frame includes at least two support members being spaced from each other and being rigidly connected by a multiple of crosspieces constituting drying rungs, each of said support members has a free end which is shaped into a U-shaped configuration and is adapted to surround a top edge of a support panel and to extend the U-shaped configuration of said supported members to contact a rear surface of said support panel, said support members further extend forward at an angle relative to an outer surface of said support panel, said support members each having a rearward end where they contact said top edge and a free forward end, said angle being maintained by braces, wherein each of the braces are rigidly connected to said support members between said rearward end and said free forward end and said braces are extending toward said outer surface of said support panel and are in contact therewith.

2. The drying device of claim 1 wherein said rigid frame is made of plastic material.

3. The drying device of claim 1 wherein said rigid frame is made of metal and is coated with an epoxy.

4. The drying device of claim 1 wherein said rungs are three in number and a center rung of said rungs is extended beyond each of said support members and is bent to extend toward said support panel to constitute said braces.

5. The drying device of claim 1 including a separate brace rigidly connected to each of said support members and extending toward said support panel and in contact therewith.

6. The drying device of claim 1 wherein each of said braces is formed by bending each of said support members to extend toward said support panel and in contact therewith and further by bending each of said support members to extend away from said support panel to reinforce the said support members.

7. The drying device of claim 1 including cushioning caps each provided on each end of said braces that is in contact with said support panel.

8. The drying device of claim 1 including cushioning caps each provided on each end of said braces that is in contact with a rear surface of said support panel.

9. The drying device of claim 1 including protective sleeves placed on said free ends at each of said support members at a location that is in contact with said upper edge of said support panel.

* * * * *